US005779186A

United States Patent [19]

Bakker et al.

[11] Patent Number: 5,779,186

[45] Date of Patent: Jul. 14, 1998

[54] MULTI-PART REEL FOR ELECTRICAL TERMINALS AND THE LIKE

[75] Inventors: John Henry Bakker, Cortland; Edward Joseph Miller, Youngstown; Scott Duncan Welsh, Aurora, all of Ohio

[73] Assignee: General Motors Corporation, Detroit, Mich.

[21] Appl. No.: 832,221

[22] Filed: Apr. 3, 1997

[51] Int. Cl.[6] ..... B65H 75/14

[52] U.S. Cl. ..... 242/609.1; 242/608.6

[58] Field of Search ..... 242/608, 608.6, 242/609, 609.1, 609.3, 118.4, 118.6, 118.61

[56] References Cited

U.S. PATENT DOCUMENTS

| | | | |
|---|---|---|---|
| 3,041,005 | 6/1962 | Wallace | 242/609.1 |
| 3,143,313 | 8/1964 | Purzycki | 242/609 |
| 4,068,808 | 1/1978 | King | 242/118.4 |
| 4,101,095 | 7/1978 | Carter . | |
| 4,226,381 | 10/1980 | Katata . | |
| 4,266,738 | 5/1981 | Nakagawa . | |
| 4,289,282 | 9/1981 | Kohno . | |
| 4,473,194 | 9/1984 | Kashimura . | |
| 4,515,323 | 5/1985 | Rood et al. | 242/609 |
| 4,570,869 | 2/1986 | Tsuji | 242/609 |
| 4,629,136 | 12/1986 | Vallance | 242/608.6 |
| 4,702,429 | 10/1987 | Black . | |
| 4,726,534 | 2/1988 | Chenoweth | 242/609.3 |
| 4,867,391 | 9/1989 | Resch | 242/609.1 |
| 4,893,764 | 1/1990 | Juntunen . | |
| 5,114,089 | 5/1992 | Posso | 242/608.6 |
| 5,524,850 | 6/1996 | Liao | 242/608.6 |
| 5,531,399 | 7/1996 | Weisburn et al. | 242/608.6 |

FOREIGN PATENT DOCUMENTS

| | | | |
|---|---|---|---|
| 63-180685 | 7/1988 | Japan | 242/608.6 |
| 1-98575 | 4/1989 | Japan | 242/608.6 |
| 6-127839 | 5/1994 | Japan | 242/608.7 |

*Primary Examiner*—John P. Darling
*Attorney, Agent, or Firm*—Cary W. Brooks; Howard N. Conkey

[57] ABSTRACT

A multi-part reel of molded plastic construction has two parts that are identical. Each part has a flange and an inner hub portion and an outer hub portion that are integrally connected to the flange so as to project in an axial direction; a plurality of circumferentially spaced hooks that interconnect with the hooks of the other to hold the parts together when the parts are mated and indexed in the circumferential direction; and a tangential lock arm that interlocks with the lock arm of the other to hold the parts in the indexed position. The lock arms has flexible arrow shaped heads that are aligned with access ports to visually assist in the assembly and disassembly of the reel parts and to permit disengagement of the lock arms for disassembly of the reel parts. The reel parts have axial fingers for centering the reel parts, slots for anchoring material to the reel for a winding operation and drive holes for rotating the reel in winding or feeding operations.

10 Claims, 4 Drawing Sheets

MULTI-PART REEL FOR ELECTRICAL TERMINALS AND THE LIKE

TECHNICAL FIELD

This invention relates generally to reels for winding material for handling and production use, and more particularly to multi-part reels for handling and long ribbons of metal electrical terminals and the like.

BACKGROUND OF THE INVENTION

Electrical terminals are typically progressively die formed in long ribbons of terminals spaced and interconnected by carrier strips. These long terminal ribbons are usually wound on reels for handling and production use in terminal applicators which feed the terminals from the reels to a crimp station where the end terminal is crimped to the end of a conductor wire and then severed from the end of the ribbon. The new end terminal is then crimped to the end of the next conductor wire and severed, and so on until all the terminals on the reel are crimped to the ends of conductor wires.

In the past, the terminal producing industry has wound long ribbons of terminals on a variety of reels for handling and use in terminal applicators. Known reels use material ranging from cardboard to machined metal and include reels of multi-part construction having parts that are held together with glue, adhesive or fasteners such as nails, screws, or bolts.

Gluing reel parts together is becoming increasingly difficult due to environmental concerns and the use of fasteners is expensive as a number of fasteners must be produced, handled and assembled to the parts to fabricate each reel.

SUMMARY OF THE INVENTION

The object of this invention is to provide a multi-part reel for winding material, such as long ribbons of metal electrical terminals, for handling and production use of the material that is economical to manufacture.

Another object of the invention is to provide a reel of multipart construction that does not require any glue, adhesive or fasteners, such as nails, screws, or bolts to fasten the reel parts together.

A feature of the invention is that the multi-part reel comprises molded plastic parts that are fastened to each other by integral portions of the molded plastic parts.

Another feature of the invention is that multi-part reels of particular sizes that can be made from two identical parts that are fabricated in the same mold.

Yet another feature of the invention is that multi-part reels can be made in a wide range of widths using relatively few molds.

Still yet another feature of the invention is that the multi-part reel can be disassembled while material, such as ribbons of metal electrical terminals remain wound on the reel for visual inspection of the material.

These and other objects, features and advantages of the invention will become more apparent from the following description of a preferred embodiment taken in conjunction with the accompanying drawing.

DESCRIPTION OF THE PREFERRED EMBODIMENT

Figure 1:
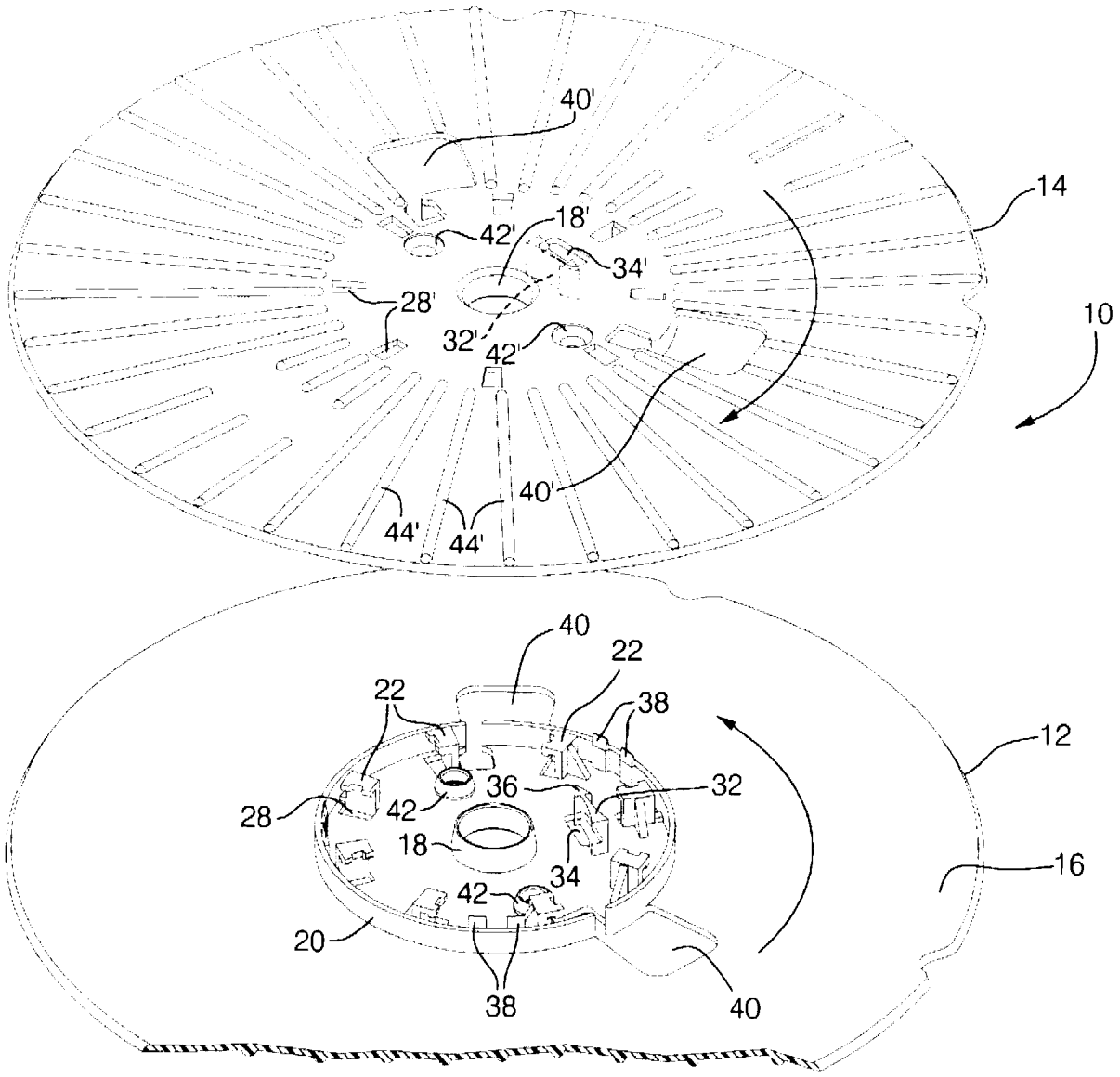
FIG. 1 is an exploded perspective view of a multi-part reel in accordance with the invention.

Referring now to the drawing and particularly to FIG. 1, the multi-part reel 10 comprises parts 12 and 14 of molded plastic material such as polystyrene. Parts 12 and 14 are preferably identical so that both reel parts can be fabricated from the same mold thereby saving manufacturing costs, inventory costs and repair costs.

Figure 3:
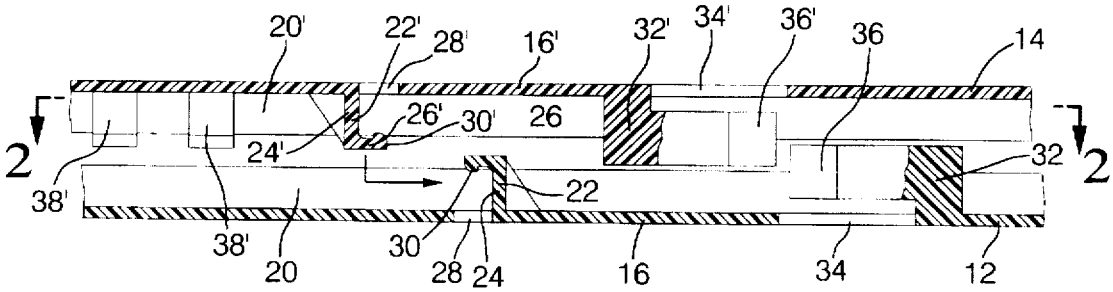
FIG. 3 is a section taken substantially along the line 3—3 of FIG. 2 looking in the direction of the arrows.
Figure 5:
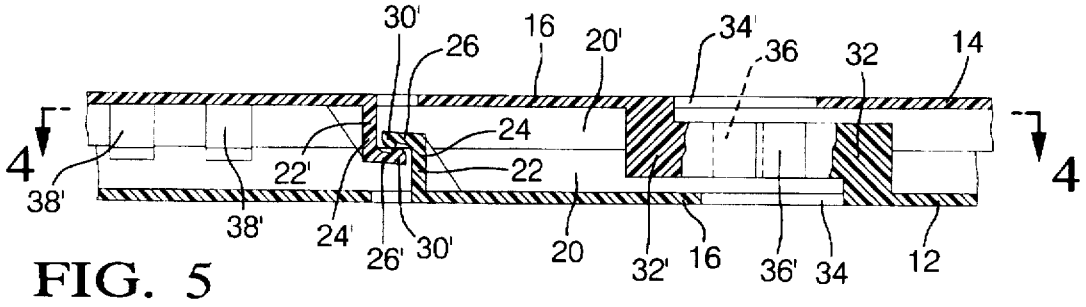
FIG. 5 is a section taken substantially along the line 5—5 of FIG. 4 looking direction of the arrows.
Figure 7:
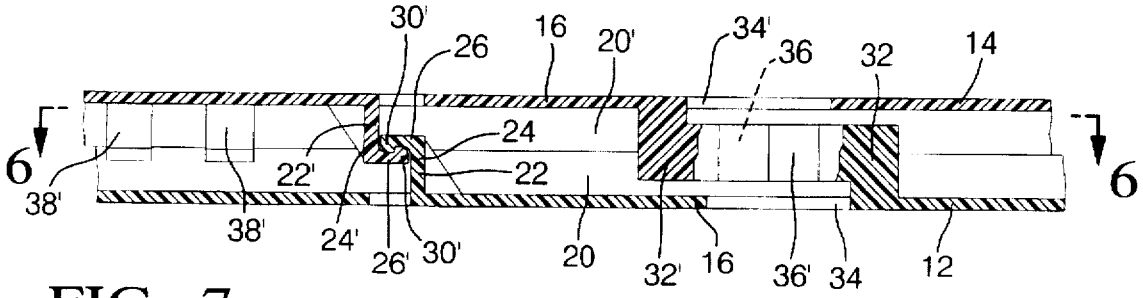
FIG. 7 is a section taken substantially along the line 7—7 of FIG. 6 looking in the direction of the arrows.

Reel part 12 has a flange 16 and an inner hub portion 18 and an outer hub portion 20 that are integrally connected to the flange so as to project in an axial direction. Reel part 12 also has a plurality of circumferentially spaced hooks 22 that extend outwardly of the outer hub portion 20 in the axial direction as best seen in FIGS. 3, 5 and 7. Hooks 22 are generally L-shaped to provide axially extending stops 24 with perpendicular tabs 26 at the ends. Hooks 22 are associated with radial slots 28 in the flange 16 to facilitate molding of the tabs 26 at the free ends of the stops 28. The hooks 22 may include gussets to increase the stiffness of the axially extending stops 24 which limit relative rotation or indexing of the reel parts 12 and 14 with respect to each other in one circumferential direction. Tabs 26 are stiffly flexible to facilitate interlocking as explained below. Tabs 26 preferably have nibs 30 at the free end as best shown FIGS. 3, 5 and 7.

Reel part 12 further includes a tangential lock arm 32 that is located between the inner hub portion 18 and the outer hub portion 20 in the radial direction. Lock arm 32 is associated with an access port 34 in the flange 16 and extends outwardly of the outer hub portion 20 in the axial direction as best shown in FIGS. 3, 5 and 7. Lock arm 32 has a tail that is integrally connected to the flange 16 and a flexible arrow-shaped head 36 that overlies the access port 34. This overlying relationship provides visibility of the arrow-shaped head 36, increases the flexibility of the arrow shaped head 36 and allows the lock arm 32 to be disengaged for disassembly of the reel 10 and visual inspection of the material wound on the reel 10 as explained below.

Reel part 12 further includes a plurality of axial flange 38 that extend outwardly of the outer hub portion 20 for locating the reel parts 12 and 14 with respect to each other in the radial direction. Two loading slots 40 extend through the flange 16 and the outer hub portion 20 for anchoring a ribbon of material to the reel 10 and two diametrically opposed flanged drive holes 42 are provided in the flange 16 for coupling the reel 10 to a winding mechanism or a feed mechanism.

Reel part 14 is identical to reel part 12 and corresponding portions and elements are identified with numerals that are the same but primed. For instance, reel part 12 is illustrated as having a flange 16 whereas reel part 14 is illustrated as having a corresponding flange 16'. The outer surfaces of the flanges 16 and 16' may include radial stiffening ribs, such as the radial stiffening ribs 44' shown on flange 16' in FIG. 1. Flange 16 being identical to flange 16' has corresponding ribs but the ribs are not shown.

Figure 2:
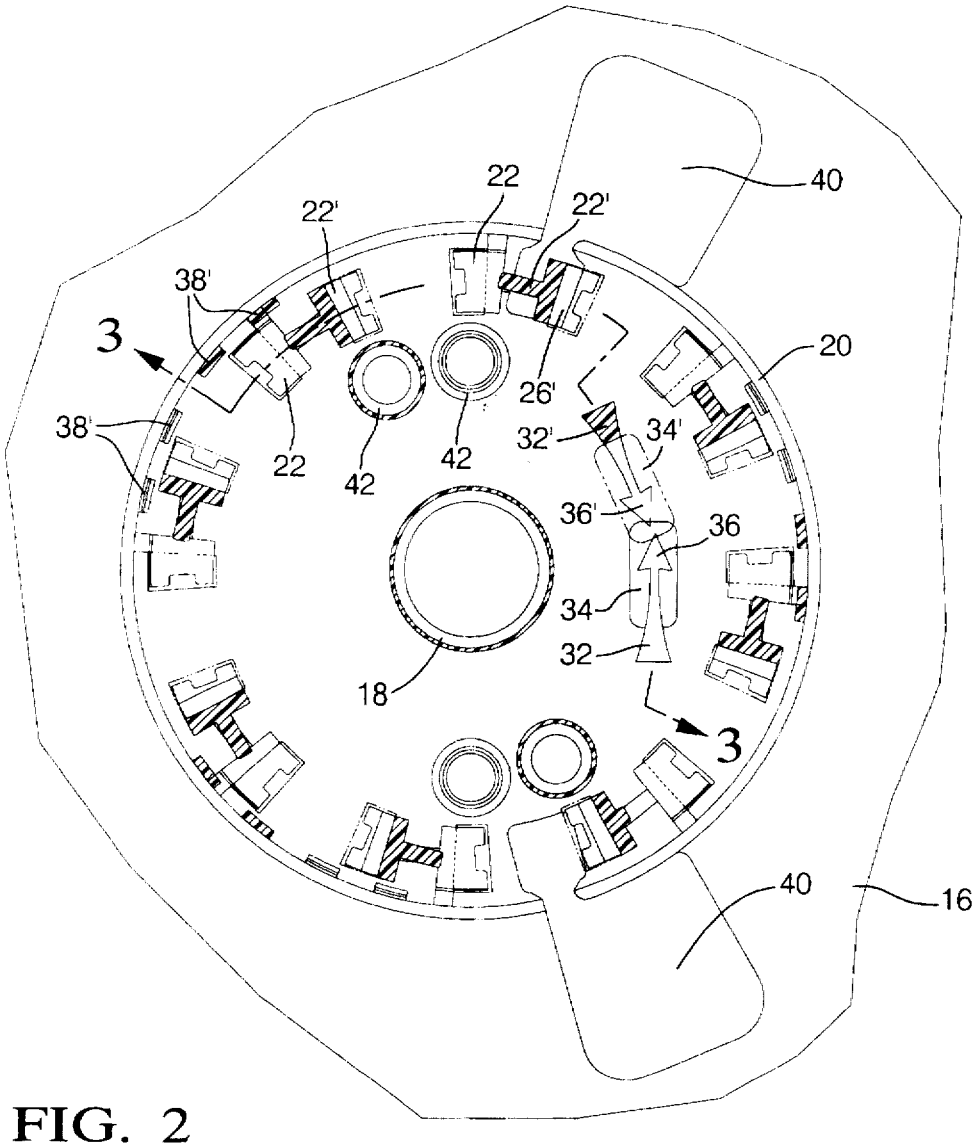
FIG. 2 partially sectioned plan view of the multi-part reel in a partially assembled condition taken substantially along the line 2—2 ofFIG. 3 looking in the direction of the arrow.

Reel parts 12 and 14 are assembled to each other by placing the two reel parts 12 and 14 next to each other so that the hub portions 18 and 20 confront each other as shown in FIG. 1 and the arrow shaped heads 36 and 36' point toward each as shown in FIGS. 2 and 3. In this position, the hooks 22 of reel part 12 fit between hooks '22 of reel part 14 and vice-versa as shown in FIGS. 2 and 3. When so positioned, reel parts 12 and 14 are then moved toward each other into piloting engagement where the axial fingers 38 and 38' of the respective reel parts 12 and 14 engage the inner surface of the adjacent outer hub portions 20 and 20' of the other reel part to locate the two reel parts 12 and 14 concentrically with respect to each other. After piloting engagement, the movement of the reel parts 12 and 14 toward each other is continued until the inner and outer hub portions 18 and 20 of reel part 12 engage the inner and outer hub portions 18' and 20 ' of reel part 14.

Figure 4:
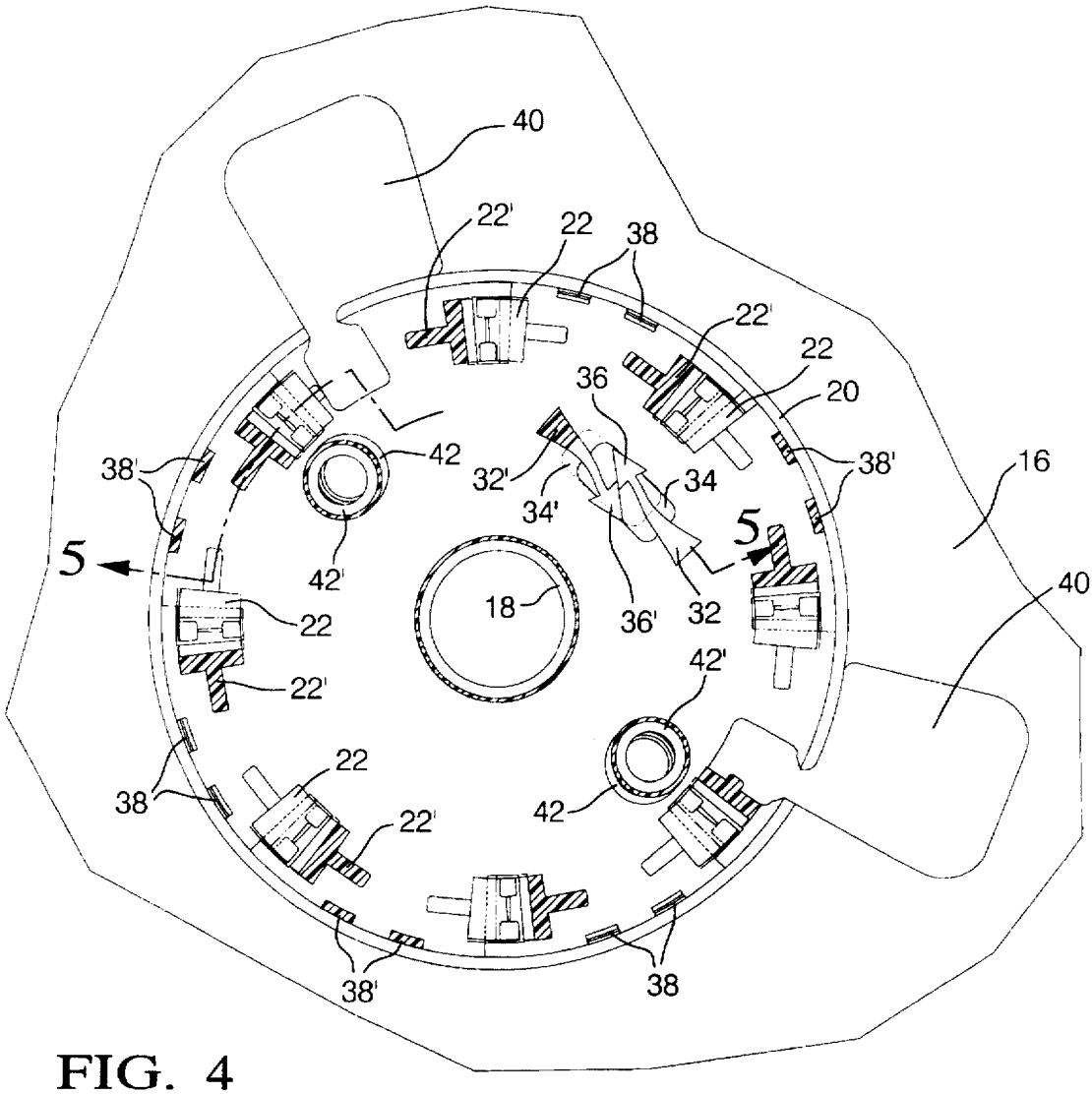
FIG. 4 is partially sectioned plan view of the multi-part reel in another partially assembled condition taken substantially along the line 4—4 of FIG. 5 looking in the direction of the arrows.

Reel parts 12 and 14 are then indexed or rotated circumferentially with respect to each other in the direction of the arrow shaped heads 36 and 36' which are visible through the access ports 34 and 34'. As the reel parts 12 and 14 are indexed circumferentially, the tabs 26 and 26' of hooks 22 and 22' engage and overlap beneath each other and the arrow shaped heads 36 and 36' engage and are deflected away from each other as shown in FIGS. 4 and 5. Tabs 26 and 26' also deflect away from each other due to nibs 30 and 30'.

Reel parts 12 and 14 are indexed or rotated circumferentially with respect to each other until the nibs 30 and 30' snap past each other and the tabs 26 and 26' bottom out against the stops 24 and 24' as shown in FIG. 7. At the same time, the arrow shaped heads 36 and 36' interlock as shown in FIG. 6 to prevent reverse or counter rotation and maintain the reel parts 12 and 14 in the indexed interlock position shown in FIG. 7 where the reel parts 12 and 14 are fully assembled to each other.

When reel parts 12 and 14 are fully assembled, inner hub portions 18 and 18' form an axle hole for rotatably mounting the reel 10 in a winding or feeding mechanism. Outer hub portions 20 and 20' form an annular support for winding a ribbon of material, such as a ribbon of metal electrical terminals spaced and interconnected by carrier strips onto the reel 10. Loading slots 40 and 40' align so that reel 10 also has two loading slots for anchoring the end of the ribbon material to the annular support formed by outer hub portions 20 and 20' and flanged drive holes 42 and 42' align to provide a pair of diametrically opposed drive pin holes.

Figure 6:
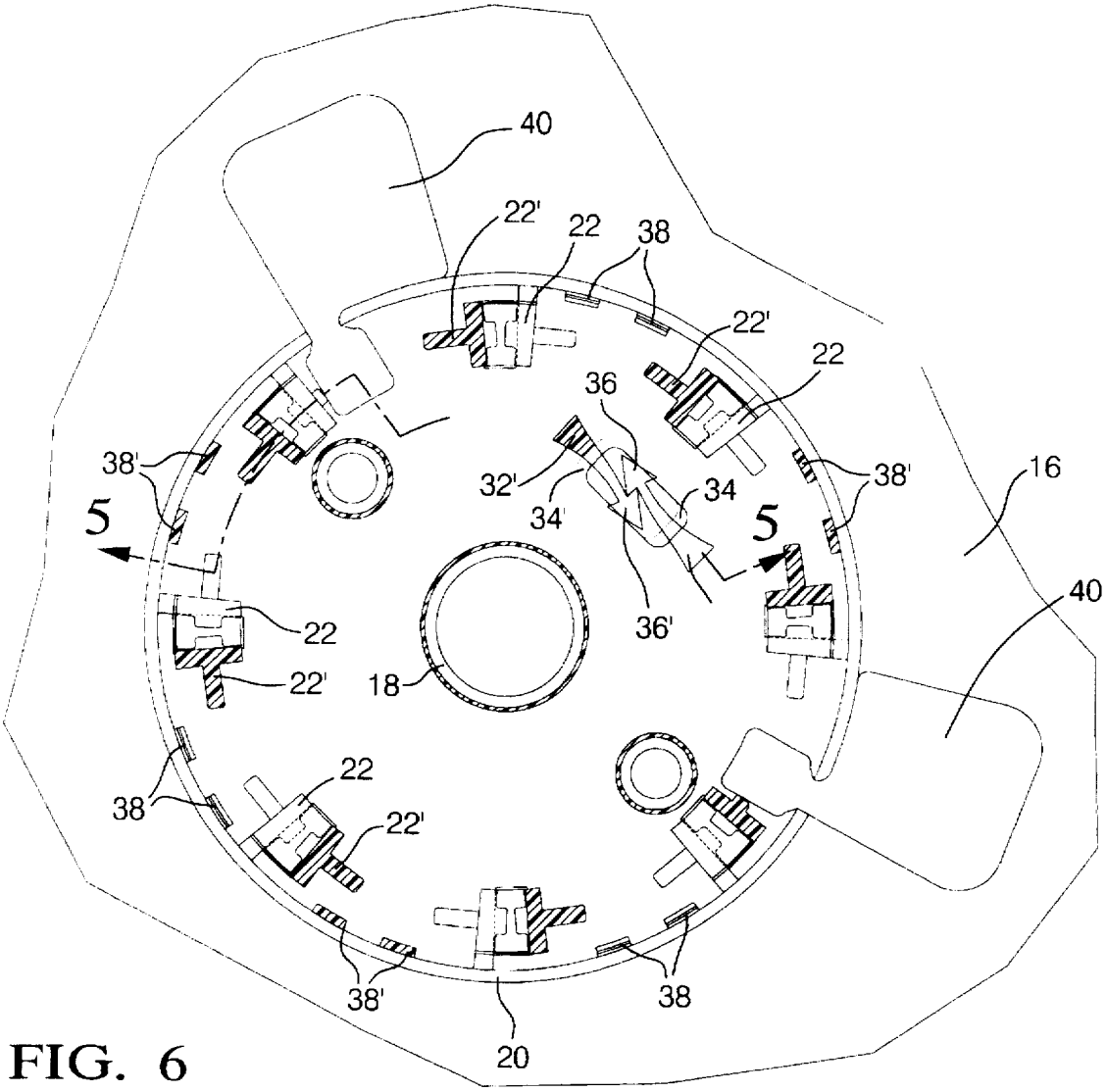
FIG. 6 is partially sectioned plan view of the multi-part reel in a completely assembled condition taken substantially along the line 6—6 of FIG. 7 looking in the direction of the arrows.

Reel 10 may also be disassembled to inspect the material that is wound on the reel by disengaging the interlocked arrow shaped heads 36 and 36' from each other through the access ports 34 and 34' as best shown in FIG. 6. After the arrow shaped heads 36 and 36' are disengaged from each other, the reel parts 12 and 14 can be rotated with respect to each other in a direction opposite the arrow shaped heads 36 and 36', that is, in a direction which separates the arrow shaped heads 36 and 36' from each other. This reverse index or rotation disengages the interlocked hooks 22 and 22' from each other. The reel parts 12 and 14 may then be separated from each other while retaining the material on one of the reel parts. The material may then be inspected visually. The reel parts 12 and 14 may also be separated for storage, repair, and/or return to the sender after the material is wound off of the reel.

As indicated above, the reel parts 12 and 14 are preferably identical so that both parts may fabricated in the same mold. However, the reel parts 12 and 14 can also be made of different widths in different molds. These reel parts of different width can then be mixed and matched to provide an extensive range of different widths with a few mold parts. For instance, two molds will produce reels with a range of three different widths; three molds will produce a range of six widths; four molds will produce a range of ten widths, etc.

It should also be noted that the preferred embodiment has flexible heads on the lock arms that are arrow shaped which is a very good shape for visually assisting the user in the assembly and disassembly of the multi-part reel 10. However, other shapes are also possible. For instance the flexible head could have one barb instead of the two barbs that characterize the arrow-shaped head. In other words, the invention has been described in an illustrative manner, and it is to be understood that the terminology which has been used is intended to be in the nature of words of description rather than of limitation.

Obviously, many modifications and variations of the present invention in light of the above teachings may be made. It is, therefore, to be understood that, within the scope of the appended claims, the invention may be practiced otherwise than as specifically described.

We claim:

1. A multi-part reel of molded plastic construction comprising a first part and a second part, the first part having a first flange and a first inner hub portion and a first outer hub portion that are integrally connected to the first flange so as to project in an axial direction, the first part having a plurality of first circumferentially spaced hooks that extend outwardly of the first outer hub portion in the axial direction, the first part having a first tangential lock arm that is located between the first inner hub portion and the first outer hub portion in a radial direction and that extends outwardly of the first outer hub in the axial direction, the second part having a second flange and a second inner hub portion and a second outer hub portion that are integrally connected to the second flange so as to project in an axial direction, the first inner hub portion engaging the second inner hub portion to provide an axle hole for the reel, the first outer hub portion engaging the second outer hub portion to provide an annular support for winding material onto the reel, the second part having a second plurality of circumferentially spaced hooks that engage the first plurality of circumferentially spaced hooks to fasten the first part and the second part together in the axial direction and to limit rotation of the first part with respect to the second parts in one direction, and the second part having a second tangential lock arm that is located between the second inner hub portion and the second outer hub portion in a radial direction and that engages the first tangential lock arm to prevent relative rotation of the first part with respect to the second part in an opposite direction.

2. The multi-part reel as defined in claim 1 wherein the first part has a plurality of axial fingers that extend outwardly of the first outer hub portion and engage an inner surface of the second outer hub portion for locating the first part concentrically with respect to the second part.

3. The multi-part reel as defined in claim 2 wherein the first part and the second part are identical.

4. The multi-part reel as defined in claim 1 wherein the first flange has a first access port for disengaging the first tangential lock arm from the second tangential lock arm.

5. The multi-part reel as defined in claim 4 wherein the first tangential lock arm has a flexible arrow-shaped head that overlies the first access port.

6. The multi-part reel as defined in claim 5 wherein the first part and the second part are identical.

7. The multi-part reel as defined in claim 1 wherein the first part has a first slot that extends through the first flange and the first outer hub portion for anchoring a ribbon of material to the reel and a first drive hole for rotating the reel in a winding or feeding mechanism.

8. The multi-part reel as defined in claim 7 wherein the first and the second parts are identical.

9. A multi-part reel of molded plastic construction comprising a first part and a second part, the first part having a first flange and a first inner hub portion and a first outer hub portion that are integrally connected to the first flange so as to project in an axial direction, the first part having a plurality of first of circumferentially spaced hooks that extend outwardly of the first outer hub portion in the axial direction, the first part having a first tangential lock arm that includes a flexible head that is aligned with an access port in the first flange and that extends outwardly of the first outer hub portion in the axial direction, the second part having a second flange and a second inner hub portion and a second outer hub portion that are integrally connected to the second flange so as to project in an axial direction, the first inner hub portion engaging the second inner hub portion to provide an axle hole for the reel, the first outer hub portion engaging the second outer hub portion to provide an annular support for winding material onto the reel, the second part having a second plurality of circumferentially spaced hooks that extend outwardly of the second outer hub portion in the axial direction and overlap and interlock with the first plurality of circumferentially spaced hooks to fasten the first part and the second part together in the axial direction and to limit rotation of the first part with respect to the second parts in one direction, the second part having a second tangential lock arm that includes a second flexible head that is aligned with an access port in the second flange and that extends outwardly of the second outer hub in the axial direction, the second flexible head interlocking with the first flexible head to prevent rotation of the first part with respect to the second part in an opposite direction, and the first part having a plurality of axial fingers that extend outwardly of the first outer hub portion in the axial direction and engage an inner surface of the second outer hub portion for locating the first reel part with respect to the second reel part in the radial direction.

10. The multi-part reel as defined in claim 9 wherein:

the first part has a first slot that extends through the first flange and the first outer hub;

the first flange has a pair of diametrically opposed flanged drive holes;

the first flexible head has a barb, and the second part is identical to the first part.

* * * * *